US005735088A

United States Patent [19]

Hashino

[11] Patent Number: 5,735,088

[45] Date of Patent: Apr. 7, 1998

[54] STAIRCASE HOIST FOR WHEELCHAIR USERS

[75] Inventor: Satoshi Hashino, Tsuchiura, Japan

[73] Assignee: Agency of Industrial Science & Technology, Ministry of International Trade & Industry, Tokyo, Japan

[21] Appl. No.: 642,899

[22] Filed: May 6, 1996

[51] Int. Cl.[6] ..... E04F 11/18

[52] U.S. Cl. ..... 52/184; 187/200; 187/201

[58] Field of Search ..... 52/184; 5/83.1, 5/81.1 R, 81.1 C, 81.1 HS, 86.1; 414/921; 280/DIG. 10, 5.2, 5.22, 5.24; 187/200–202

[56] References Cited

U.S. PATENT DOCUMENTS

| | | | |
|---|---|---|---|
| 4,253,287 | 3/1981 | Overmoe | 52/184 |
| 4,335,805 | 6/1982 | Grass | 187/201 |
| 4,345,669 | 8/1982 | Noall | 187/201 |
| 4,627,517 | 12/1986 | Bor | 187/201 |
| 4,756,387 | 7/1988 | Grass | 187/201 |
| 4,913,264 | 4/1990 | Voves et al. | 187/201 |
| 5,050,708 | 9/1991 | Wood | 187/201 |
| 5,105,914 | 4/1992 | Holden | 187/201 |
| 5,193,650 | 3/1993 | Kent | 187/201 |
| 5,230,405 | 7/1993 | Barlelt | 187/201 |
| 5,269,227 | 12/1993 | Warren et al. | 187/201 X |
| 5,363,771 | 11/1994 | Warren et al. | 187/201 X |
| 5,476,155 | 12/1995 | Nakatani et al. | 187/201 X |

FOREIGN PATENT DOCUMENTS 3 17755 3/1991 Japan .

*Primary Examiner*—Carl D. Friedman
*Assistant Examiner*—Beth A. Aubrey
*Attorney, Agent, or Firm*—Oblon, Spivak, McClelland, Maier & Neustadt, P.C.

[57] ABSTRACT

A staircase hoist for wheelchair users includes a hoist carrier plate having a pair of brackets, two guide rails in slidable engagement with the pair of brackets to maintain the hoist carrier plate in a prescribed attitude, the guide rails being disposed vertically parallel to one another on a staircase wall along an angle of flight of the staircase, a drive motor on the hoist carrier plate, a plurality of arms radiating from a drive shaft rotated by the motor that rotate in opposition to the staircase wall, a tip of each arm having a roller, and a plurality of drive guides disposed between the guide rails at a prescribed distance from the wall that sequentially engage with the rollers on the arms. The drive shaft that rotates the arms is set at an angle to the staircase wall to prevent rollers that have terminated engagement with a drive guide coming into contact with other drive guides while being rotated around into position for the next engagement.

10 Claims, 2 Drawing Sheets

STAIRCASE HOIST FOR WHEELCHAIR USERS

BACKGROUND OF THE INVENTION

1. Field of the Invention

The present invention relates to a staircase hoist for wheelchair users in family life and in public facilities such as stations, libraries and city halls.

2. Description of the Prior Art

Steps and staircases in stations and other facilities form a major obstacle to wheelchair users. Particularly in cities—where there are many high-rise buildings—public buildings such as libraries, city halls and stations, and shopping centers and other places frequently utilized by disabled persons, opportunities for disabled persons to actively participate in society are quite limited by a lack of consideration relating to movement of such persons. In this context, to support such participation there is an urgent need to develop simple systems that permit disabled persons to go up and down stairs. There do exist systems, such as a system that comprises two rails attached to the wall of a staircase to act as guides for a hoist carrier plate, and using rope and/or gears along one of the guide rails to move the hoist carrier plate up and down.

Such a system has to be functionally useful to disabled persons. At the same time, however, it is necessary that the system does not hinder the movement of non-disabled persons. For this, it is necessary to position the fixed part of the installation structure so that movement of non-disabled persons is not obstructed, and to enable movable structures to be put out of the way, such as behind the staircase, when not in use. To promote wider use of the system, in addition to performing the necessary moving functions it must be low-cost, easy to install and simple to maintain. Existing systems do not always meet all these criteria. In addition, using one of the guide rails to transmit motive power places an eccentric loading distribution on the system that hinders smooth movement.

SUMMARY OF THE INVENTION

An object of the present invention is to provide a staircase hoist for wheelchair users that has a straightforward structure, is readily installed, simple to maintain, inexpensive, and safe.

Another object of the invention is to provide a staircase hoist for wheelchair users that does not hinder the movement of non-disabled persons.

In accordance with the present invention, the above objects are attained by a staircase hoist for wheelchair users, comprising a hoist carrier plate having a pair of brackets, two guide rails in slidable engagement with the pair of brackets to maintain the hoist carrier plate in a prescribed attitude, the guide rails being disposed vertically parallel to one another on a staircase wall along an angle of flight of the staircase; a drive motor on the hoist carrier plate, retaining means retaining a plurality of engagement members thereon and rotated by a drive shaft rotated by the motor that rotate in opposition to the staircase wall, a tip of each arm having an engagement member, a plurality of drive guides disposed between the guide rails at a prescribed distance from the wall that sequentially engage with the engagement members on the arms, and contact prevention means whereby engagement members that have terminated engagement with a drive guide do not come into contact with drive guides while being rotated around into position for a next engagement.

In the above staircase hoist, the drive shaft that rotates the arms is inclined at an angle to the staircase wall, so that between the time a roller ends one engagement with a drive guide and the time the roller is moved around for its next engagement with another drive guide, the roller is moved along a path that keeps the roller separated from the other drive guides.

When the motor is operated to move the hoist carrier plate up the staircase, an arm roller is moved onto and along a drive guide, thereby causing the drive shaft to be moved up the staircase. During the movement of the hoist carrier plate, the attitude of the carrier plate is maintained by the brackets guided by the rails. This arrangement prevents the driving force being unevenly distributed between the guide rails/brackets, thereby facilitating the smooth operation of the hoist.

The guide rails are like a hand rail, and the drive guides are positioned between the guide rails on the wall side of the rails; use of the staircase by non-disabled persons is not hindered. In addition, the guide rails can be used to move the hoist out of the way when it is not being used. Arm rollers roll along the drive guides, so lubrication is not required. Therefore, clothing coming into contact with the hoist does not get dirty. The drive guides are formed from piping, which poses less risk of injury to children. The arm rollers only move along the drive guides when the arms are being rotated by the drive shaft. This provides safety, since in the event of a power outage or the like, the hoist cannot fall. The guide rail and hoist carrier plate arrangements are structurally straightforward and do not have to be implemented with a high level of precision. This makes the system easier and cheaper to manufacture and install.

DESCRIPTION OF THE PREFERRED EMBODIMENT

Figure 1:
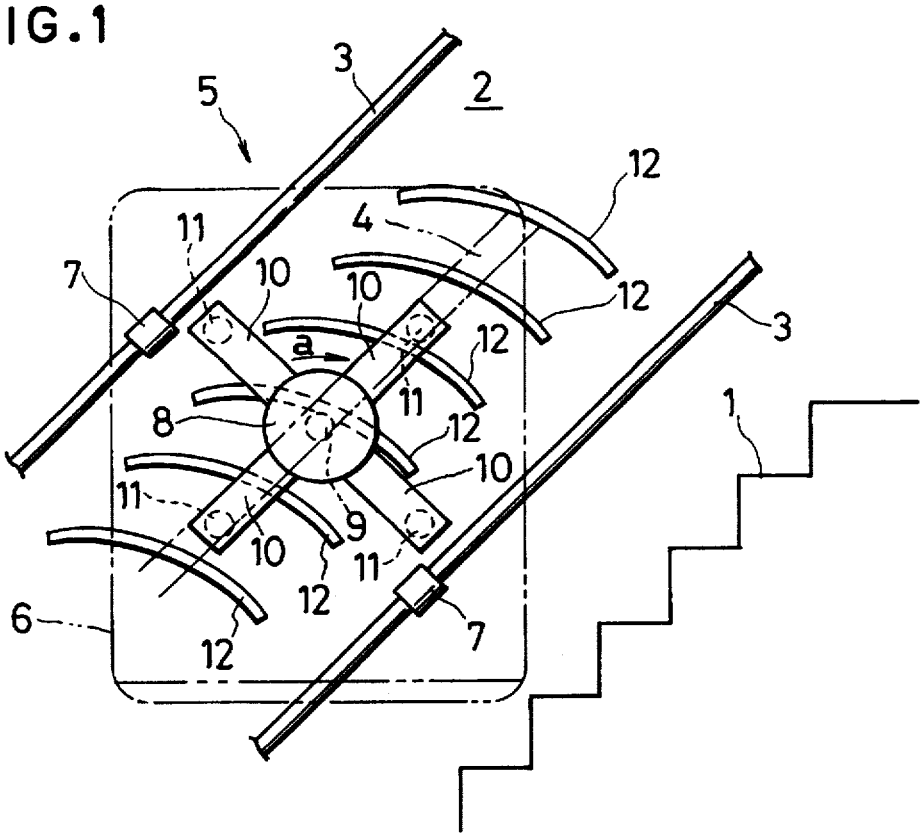
FIG. 1 is a side view of an embodiment of the staircase hoist for wheelchair users according to the present invention.

FIG. 1 shows an embodiment of the staircase hoist for wheelchair users according to the present invention. The system comprises a pair of guide rails 3 attached to a wall 2 in parallel, one rail above the other, so that the guide rails 3 follow the angle of flight of the staircase 1. A hoist 5 carrying a wheelchair and its occupant can be moved along the guide rails 3, enabling a wheelchair user to readily go up the stairs.

The hoist 5 includes a hoist carrier plate 6 on which the wheelchair is mounted, and brackets 7 that are slidably attached to the guide rails 3 and maintain the attitude of the hoist carrier plate 6. The hoist 5 also has a drive device such as a motor 8 for driving the hoist carrier plate 6 along the guide rails 3. The brackets 7 encircle the guide rails 3 along which the brackets 7 can slide to move the hoist carrier plate 6 along the guide rails 3 without using gear wheels or the like. The absence of such gear wheels eliminates the need to equip the guide rails 3 with a rack or the like. Instead, the guide rails 3 only need to be able to support the weight of the hoist 5. The guide rails 3, therefore, can be formed of hard plastic or other such material. As there are no gear wheels or racks, there is no oil or grease to get on people's clothing. Moreover, the above configuration, in which the hoist carrier plate 6 is supported on the guide rails 3 by the brackets 7, facilitates movement of the hoist 5 along guide rails, which are curved in a flat plane.

Figure 2:
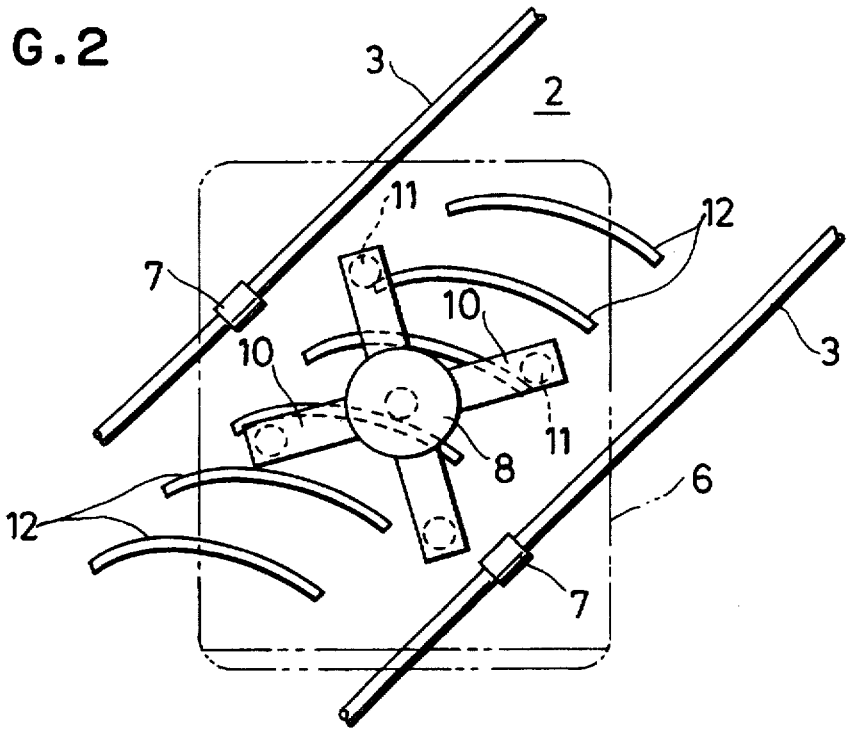
FIG. 2 shows the hoist of FIG. 1 during ascension.
Figure 3:
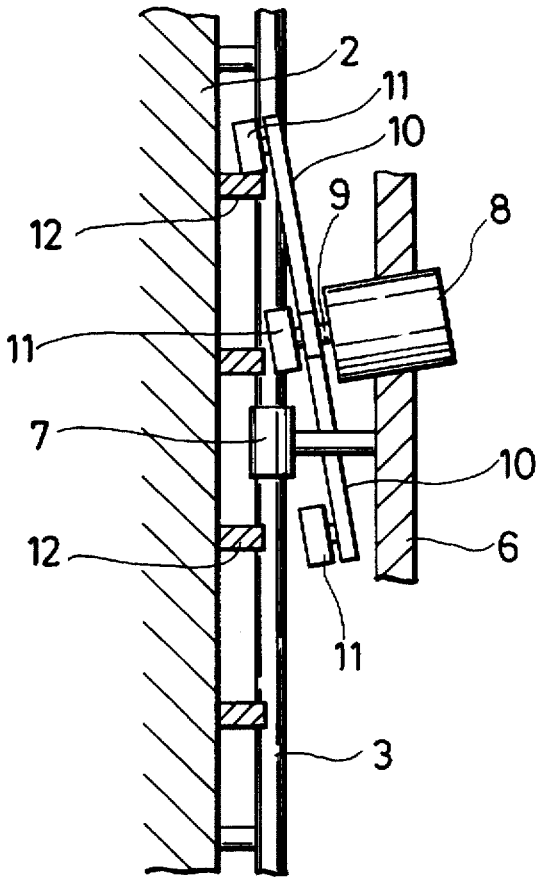
FIG. 3 is a cross-sectional view of the principal parts of the hoist of FIG. 1.

The motor 8 is mounted on the hoist carrier plate 6 and has a drive shaft 9 that projects toward the wall 2. Arranged opposite to the wall 2 are multiple arms 10 extending radially from the drive shaft 9 by which the arms 10 are rotated. At the end of each of the arms 10 is an engager, such as a roller 11. Each of these rollers 11 engages sequentially with drive guides 12. Instead of a plurality of arms 10, a single disk may be used provided with rollers 11 at prescribed intervals. The drive guides 12 have a guide surface 4 along which the rollers 11 are moved and are disposed in a parallel arrangement between the guide rails 3. The guide surface 4 is configured so that when a roller 11 of an arm 10 is on a drive guide 12 and the arm 10 is rotated, the movement of the roller 11 along the guide surface 4 moves the drive shaft 9 up the staircase at a more or less constant speed. Also, as shown in FIG. 2, the drive guides 12 and guide surface 4 are arranged so that by the time one roller 11 is about to move off the end of a drive guide 12, the roller 11 of the following arm 10 is moving onto the next drive guide 12. As a result, the drive shaft 9 continues to be moved up the staircase at a constant pace.

The drive guides 12 being thus arranged means that a roller 11 which has moved out of engagement off the end of a drive guide 12 can come into contact with drive guides 12 as the arm 10 concerned is rotated to bring the roller 11 around for its next engagement. Such non-hoisting engagement contact between rollers 11 and drive guides 12 has to be prevented. In accordance with this invention, this contact is prevented by setting the drive shaft 9 at an angle to the wall 2, so that between the time a roller 11 ends one engagement with a drive guide 12 and the time the roller 11 is moved around for its next engagement with a drive guide 12, the roller 11 is moved along a path that keeps the roller 11 separated from the drive guides 12. The same result can also be achieved by configuring the arms 10 so that each arm 10 can be swung away from the drive guides 12 by a cam or the like provided on the hoist carrier plate 6. With the staircase hoist thus configured, the hoist carrier plate 6 is moved up the staircase 1 by operating the motor 8 to rotate the drive shaft 9 in the direction shown by the arrow in FIG. 1. This moves a roller 11 of an arm 10 onto and along a drive guide 12, thereby moving the hoist carrier plate 6 up the staircase 1. Since the drive shaft 9 is set at an angle, the rollers 11 of arms 10 between hoisting engagements do not come into contact with drive guides 12.

During the movement of the hoist carrier plate 6, the attitude of the hoist carrier plate 6 is maintained by the brackets 7 guided by the rails 3. This arrangement prevents the driving force being unevenly distributed between the guide rails/brackets, further facilitating a smooth hoisting action. Furthermore, hoisting efficiency is good, since the rotation of the drive shaft 9 of the motor 8 is converted directly into linear motion by the drive guides 12. To move the hoist down the staircase, the motor 8 is reversed. The engagement between rollers 11 and drive guides 12 allows the hoist to descend smoothly under its own weight. Since the guide rails 3 are like a hand rail or banister, and the drive guides 12 are positioned between the guide rails 3, use of the staircase by non-disabled persons is not hindered. Moreover, the guide rails 3 can be extended and shaped to enable the hoist 5, when not in use, to be moved out of the way into a storage space or the like. This provides safety and ensures that the hoist does not get in the way of non-disabled persons. The guide rail and hoist carrier plate arrangements are structurally straightforward and do not have to be implemented with a high level of precision. This makes the system easier and cheaper to manufacture and install.

Arm rollers roll along the drive guides, so lubrication is not required. Clothing, therefore, can come into contact with the hoist without getting dirty. The drive guides are formed from piping, which is safer where children are concerned. The arm rollers only move along the drive guides when the arms are being rotated by the drive shaft. This provides safety, since in the event of a power outage or the like, the hoist cannot fall.

As described in the foregoing, the staircase hoist for wheelchair users according to this invention enables wheelchair users to use staircases. In addition, the fixed system structures do not get in the way of non-disabled persons, and the movable portions can be stored away when not in use. The hoist is also structurally simple and inexpensive, and is easy to manufacture, install and maintain.

What is claimed is:

1. A staircase hoist for wheelchair users, comprising:

a hoist carrier plate having a pair of brackets thereon;

two guide rails in slidable engagement with the pair of brackets to maintain the hoist carrier plate in a predetermined attitude, the guide rails being disposed on a wall of a staircase along an angle of flight of the staircase and in parallel to each other;

a drive motor provided on the hoist carrier plate and having a drive shaft rotatably attached to the motor;

a plurality of drive guides disposed on the wall of the staircase between the guide rails at a prescribed distance; and retaining means retaining thereon a plurality of engagement members that face the wall of the staircase and which are disposed at a prescribed distance on a circumference of a circle with the drive shaft of the drive motor as a center of the circle so that the engagement members are moved on the circumference by the drive shaft rotated by the drive motor and sequentially engage with the drive guides;

said drive shaft of the drive motor serving as contact prevention means for preventing the engagement members that have terminated engagement with one of the drive guides from coming into contact with others of the drive guides while being rotated around into position for a subsequent engagement.

2. A staircase hoist according to claim 1, wherein the contact prevention means is set at an angle with respect to the staircase wall.

3. A staircase hoist according to claim 1, wherein the engagement members are rollers.

4. A staircase hoist according to claim 1, wherein the retaining means comprises a plurality of arms radiating from the drive shaft and having one of said engagement members at each tip thereof.

5. A staircase hoist according to claim 1, wherein the retaining means comprises a disk provided with the engagement members at prescribed intervals.

6. A staircase hoist for wheelchair users, comprising:

a hoist carrier plate having a pair of brackets thereon;

two guide rails in slidable engagement with the pair of brackets to maintain the hoist carrier plate in a predetermined attitude, the guide rails being disposed on a wall of a staircase along an angle of flight of the staircase and parallel to each other;

a drive motor provided on the hoist carrier plate and having a drive shaft rotatably attached to the motor;

a plurality of drive guides disposed on the wall of the staircase between the guide rails at a prescribe distance; and a retaining mechanism retaining thereon a plurality of engagement members that face the wall of the staircase and which are disposed at a prescribed distance on a circumference of a circle with the drive shaft of the drive motor as a center of the circle so that the engagement members are moved on the circumference by the drive shaft, said engagement members rotated by the drive motor and sequentially engage with the drive guides;

said drive shaft of the drive motor serving as a contact prevention mechanism preventing the engagement members that have terminated engagement from one of the drive guides from coming into contact with others of the drive guides while being rotated around into position for a subsequent engagement.

7. A staircase hoist according to claim 6, wherein the contact prevention mechanism is set at an angle with respect to the staircase wall.

8. A staircase hoist according to claim 6, wherein the engagement members comprise rollers.

9. A staircase hoist according to claim 6, wherein the retaining mechanism comprising a plurality of arms radiating from the drive shaft, said arms having one of said engagement members at each tip thereof.

10. A staircase hoist according to claim 6, wherein the retaining mechanism comprises a disk provided with the engagement members at prescribed intervals.

* * * * *